US012064072B2

(12) United States Patent
Miller et al.

(10) Patent No.: US 12,064,072 B2
(45) Date of Patent: Aug. 20, 2024

(54) DOMESTIC APPLIANCE, SYSTEM COMPRISING A DOMESTIC APPLIANCE AND METHOD FOR OPERATING A DOMESTIC APPLIANCE

(71) Applicant: BSH Hausgeräte GmbH, Munich (DE)

(72) Inventors: Daniel Miller, Finningen (DE); Kai Paintner, Welden (DE); Alexander Rommel, Bächingen (DE); Katharina Scheck, Dillingen (DE); Helena Riehl, Munich (DE); Manuel Meyer, Munich (DE); Matthias Heckes, Munich (DE); Matthias Hüdig, Augsburg (DE)

(73) Assignee: BSH Hausgeräte GmbH, Munich (DE)

( * ) Notice: Subject to any disclaimer, the term of this patent is extended or adjusted under 35 U.S.C. 154(b) by 216 days.

(21) Appl. No.: 17/640,377

(22) PCT Filed: Aug. 25, 2020

(86) PCT No.: PCT/EP2020/073703
§ 371 (c)(1),
(2) Date: Mar. 4, 2022

(87) PCT Pub. No.: WO2021/047899
PCT Pub. Date: Mar. 18, 2021

(65) Prior Publication Data

US 2022/0330786 A1 Oct. 20, 2022

(30) Foreign Application Priority Data

Sep. 9, 2019 (DE) ..... 102019213655.9

(51) Int. Cl.
*A47L 15/00* (2006.01)
*A47L 15/42* (2006.01)
*A47L 15/46* (2006.01)

(52) U.S. Cl.
CPC ..... *A47L 15/0021* (2013.01); *A47L 15/4293* (2013.01); *A47L 15/46* (2013.01);
(Continued)

(58) Field of Classification Search
None
See application file for complete search history.

(56) References Cited

U.S. PATENT DOCUMENTS 8,721,799 B2 5/2014 Dalsing
9,743,820 B2 8/2017 Beaudet
(Continued)

FOREIGN PATENT DOCUMENTS

CN 103476050 A 12/2013
DE 19651346 A1 6/1998
(Continued)

OTHER PUBLICATIONS

National Search Report DE 102019213655.9 dated Jun. 17, 2020, 7 pages.
(Continued)

*Primary Examiner* — Eric W Golightly
(74) *Attorney, Agent, or Firm* — Michael E. Tschupp; Andre Pallapies; Brandon G. Braun

(57) ABSTRACT

A household appliance includes a control device configured to carry out a treatment program from a plurality of treatment programs, with each of the plurality of treatment programs being determined by a plurality of program parameters, an output unit configured to output a feedback survey in accordance with a feedback cycle to a user of the household appliance, and an adjustment unit configured to adjust the feedback cycle depending on a user feedback detected by an input means.

14 Claims, 5 Drawing Sheets

(52) U.S. Cl.
CPC ..... *A47L 2301/08* (2013.01); *A47L 2401/34* (2013.01); *A47L 2501/30* (2013.01)

(56) References Cited

U.S. PATENT DOCUMENTS

| | | | | |
|---|---|---|---|---|
| 10,353,901 | B2 * | 7/2019 | Cosic | G06N 5/02 |
| 2011/0209729 | A1 | 9/2011 | Beaudet | |
| 2016/0143475 | A1 | 5/2016 | Wessels | |
| 2019/0298143 | A1 | 10/2019 | Haidacher | |
| 2020/0362497 | A1 | 11/2020 | Park | |
| 2022/0022724 | A1 | 1/2022 | Miller | |

FOREIGN PATENT DOCUMENTS

| | | | | |
|---|---|---|---|---|
| DE | 102008042290 | A1 | 3/2010 | |
| DE | 102015201948 | A1 | 8/2016 | |
| DE | 102015107521 | A1 | 11/2016 | |
| EP | 1779762 | A1 | 5/2007 | |
| JP | 2003032057 | A | 1/2003 | |
| KR | 20050066324 | A | 6/2005 | |
| WO | WO-2007048482 | A1 * | 5/2007 | A47L 15/0063 |
| WO | WO-2018015124 | A1 * | 1/2018 | A47L 15/0026 |

OTHER PUBLICATIONS

National Search Report CN 2020800613926 dated Oct. 11, 2023, 3 pages.

* cited by examiner

DOMESTIC APPLIANCE, SYSTEM COMPRISING A DOMESTIC APPLIANCE AND METHOD FOR OPERATING A DOMESTIC APPLIANCE

CROSS-REFERENCES TO RELATED APPLICATIONS

This application is the U.S. National Stage of International Application No. PCT/EP2020/073703, filed Aug. 25, 2020, which designated the United States and has been published as International Publication No. WO 2021/047899 A1 and which claims the priority of German Patent Application, Serial No. 10 2019 213 655.9, filed Sep. 9, 2019, pursuant to 35 U.S.C. 119(a)-(d).

The contents of International Application No. PCT/EP2020/073703 and German Patent Application, Serial No. 10 2019 213 655.9 are incorporated herein by reference in their entireties as if fully set forth herein.

BACKGROUND OF THE INVENTION

The present invention relates to a household appliance, such as for example a water-conducting household appliance, to a system with a household appliance and to a method for operating a household appliance.

BRIEF SUMMARY OF THE INVENTION

Conventional water-conducting household appliances, such as dishwashers for example, have various automatic functions, which are intended to make the operation of the dishwasher easier for a user. These for example include an automatic program system, which depending on various factors, such as the level of soiling in a washing liquor, specific pre-settings made by the user and the like, are intended to optimize a cleaning result.

To this end document DE 196 51 346 A1 shows a dishwasher with a control device, in which a complete adaptation of the program sequence to the wide variety of levels of soiling of the dishes to be cleaned is made possible. In this invention the program sequence is able to be preselected at the control device by means of at least one parameter which is essentially able to be adjusted steplessly, needed for the washing process and influenced by said process.

The operation of household appliances by means of an App is further known. In such cases the scope of functions is restricted to just the basic functions of the household appliances, for example the selection of programs or the adaptation of the basic settings. In such cases critical functions, such as switching on or starting, are restricted via a safety function.

Furthermore requesting that the user assesses the result of the dishwashing after the end of the dishwashing program is also known, i.e. requesting them to give feedback, for example about the cleaning performance, the drying performance or the program duration. Depending on the assessment by the user, dishwashing program parameters for the next dishwashing program can be changed.

Conventional methods and apparatuses for this purpose are known from the documents U.S. Pat. No. 9,743,820 B2, DE 10 2015 107 521 A1, EP 1 779 762 B1 and U.S. Pat. No. 8,721,799 B2.

Against this background, one object of the present invention consists of improving the operation of a household appliance.

In accordance with a first aspect, a household appliance, in particular a water-conducting household appliance, is proposed. The household appliance comprises a control device for carrying out a treatment program from a plurality M of treatment programs, wherein each of the M treatment programs is determined by a plurality of program parameters, an output unit for outputting a feedback survey in accordance with a feedback cycle to a user of the household appliance, and an adjustment unit for adjusting the feedback cycle depending on feedback from the user detected by an input device.

The feedback cycle is determined by the period of time between two consecutive feedback surveys for triggering a respective feedback by the user. The feedback survey can have one or more feedback questions. For example a feedback survey can comprise a feedback question about cleaning, a further feedback question about drying and also a further feedback question about the duration of the program.

As stated above, the output unit is configured to output a feedback survey with one or more feedback questions in accordance with the feedback cycle to the user of the household appliance. Examples of such feedback questions include "Were you satisfied with the cleaning performance?", "Were you satisfied with the drying performance?", "Were you satisfied with the duration of the program?".

If the input means detects feedback of the user in response to such a feedback survey, the input means preferably forwards the feedback detected to the adjustment unit. The adjustment unit is configured in this case to adjust the feedback cycle depending on the feedback detected, i.e. to extend or reduce the time between two consecutive feedback surveys depending on the feedback detected. Moreover retaining the period of time between two consecutive feedback surveys in reaction to a feedback detected is also conceivable. In particular the adjustment unit is configured automatically to adjust the feedback cycle depending on the feedback detected. As an alternative to the automatic adjustment of the feedback cycle, the adjustment unit is preferably configured for example, by means of an output via the output unit, to make proposals to the user for a change to the feedback cycle. Preferably the output unit generates a list of different feedback cycles, e.g. one day, one week, one month, from which the user can choose by means of the input means.

Furthermore the input means is preferably configured to detect spontaneous feedback from the user, preferably at any given point in time, and forward it to the adjustment unit for further processing. In particular the user can also decline a feedback survey, for example by not giving any feedback in response to the feedback survey output or by actively aborting the feedback survey. In such a case the output unit can be configured to output a new feedback survey to the user at a later time, in particular at a time that can be set.

The household appliance is embodied for example as a dishwasher, such as a household dishwasher, as a cooking appliance, as a refrigeration appliance, as a washing machine, as a water heater or as a coffee machine. The cooking appliance is an oven, a microwave, a hob or a steam cooker for example. The refrigeration appliance is a refrigerator for example.

The control device can be implemented by hardware and/or by software. The same applies to the respective units, for example the adjustment unit. The control device is in particular integrated into the household appliance. Preferably the control device integrates the output unit and the adjustment unit.

As an alternative the control device can also be arranged outside the household appliance. When implemented by hardware the control device can be embodied as a computer or as a microprocessor for example. When implemented by software the control device can be embodied as a computer program product, as a function, as a routine, as a part of program code or as an executable object.

For example the treatment program can comprise a dishwashing program for washing dishes and/or a cleaning program for cleaning of parts of the household appliance, for example a filter. The control device is configured to carry out a dishwashing program from a number of dishwashing programs for washing dishes. A dishwashing program comprises different subprogram steps, for example, such as for example prewashing, cleaning, rinsing and/or drying. Various dishwashing programs differ for example in a sequence and/or type of the subprogram steps, and also in various operating parameters, such as for example a duration and/or a washing liquor temperature of one or more subprogram steps.

For washing by the household dishwasher, dishes are arranged in the washing compartment, in particular on one or more receptacles to accommodate the dishes. The dishes comprise in particular various items of crockery, cutlery and/or tools, which are used for the preparation, the storage and/or the consumption of food. These are for example plates, pots, cups, knives, glasses and more besides.

In accordance with one form of embodiment the adjustment unit is configured to automatically extend the feedback cycle for feedback detected by the input means with a positive content or to offer the user an extension of the feedback cycle by means of an output through the output unit.

The output through the output unit can for example be a list with a number of different periods for extended feedback cycles, from which the user can select by means of the input means.

Such an output can be organized as follows for example: "Please select a new extended feedback cycle:

a) One month
b) Two months
c) Three months"

As well as the option of outputting absolute numbers for the extension of the feedback cycle, as shown above, the output can also comprise relative expression, such as for example:

"Please select for the extension of the feedback cycle:

a) A doubling
b) A tripling
c) A quadrupling"

In accordance with a further form of embodiment the adjustment unit is configured to automatically reduce the feedback cycle for feedback detected by the input means with a negative content or to offer the user a reduction of the feedback cycle by means of an output through the output unit.

Such an output can be designed as follows for example: "Please select a new reduced feedback cycle:

a) One week
b) Two weeks
c) One month"

Relative expressions can also be used for the output for reducing the feedback cycle.

In accordance with a further form of embodiment the adjustment unit is configured to adjust the feedback cycle depending on the user feedback detected by the input means and depending on data detected during the use of the household appliance.

The use of the data detected during the use of the household appliance enables the adjustment of the feedback cycle to be refined and thereby improved.

In accordance with a further form of embodiment the data detected during the use of the household appliance comprises Data about device settings of the household appliance,
Data about treatment programs carried out,
Data about inputs by the user made during the treatment programs carried out and detected by the input means,
An assessment history comprising a plurality of user feedbacks detected by the input means during the treatment programs carried out, and/or
At least one sensor signal or a series of sensor signals of a number of sensors built into the household appliance.

In accordance with a further form of embodiment the sensors built into the household appliance comprise a turbidity sensor, a soiling level sensor, a drying sensor and/or a camera arranged in a treatment space of the household appliance. The washing compartment of the household dishwasher is an example of a treatment space of the household appliance.

In accordance with a further form of embodiment the adjustment unit is further configured to adapt a content of the feedback survey depending on the user feedback detected.

The possible adaptation of the content of the feedback survey depending on the user feedback detected enables the operation of the household appliance to be further improved.

If for example a user gives feedback of "Poor drying performance" then the adjustment unit can formulate the content of the feedback survey as follows:

"Please select one of the following for improving the drying:

a) Increase the drying intensity by 1
b) Increase the drying intensity by 2
c) Increase the drying intensity by 3"

In accordance with a further form of embodiment the adjustment unit is further configured to adapt a content of the feedback survey depending on the user feedback detected and depending on data detected during the use of the household appliance.

The use of the data detected during the use of the household appliance for formulation of the content of the feedback survey enables the feedback survey to be further specified and refined, whereby the operation of the household appliance can be further improved.

In accordance with a further form of embodiment a memory facility is provided, which is configured to store a series of a plurality of user feedbacks detected by the input means for a series of treatment programs carried out, wherein the feedback detected in each case is stored assigned to the respective treatment program carried out.

In accordance with a further form of embodiment the control device is configured, for a specific user feedback detected by the input means, to select a treatment program of the series of treatment programs stored by the memory facility and to carry out the selected treatment program.

If for example the user gives feedback of "The performance was better last time", then the control device can go back in the stored series of feedbacks given and then select once again the last but one program carried out.

In accordance with a further form of embodiment the control device is embodied, for specific feedback detected by the input means with a negative content, to select one of the treatment programs which is stored in the memory facility assigned to a specific feedback with a positive content and to carry out the selected treatment program.

In accordance with a further form of embodiment the memory facility is embodied to store the M treatment programs in the form of an N-dimensional matrix, wherein each matrix element of the matrix is assigned one of the M treatment programs, wherein the respective matrix element is able to be determined by one of a plurality of specific N-dimensional input vectors.

In accordance with a further form of embodiment the household appliance comprises a selection unit for selecting one of the specific N-dimensional input vectors depending on a user input detected by the input means for changing at least one of the program parameters, and a determination unit for determining a matrix element from the matrix by means of the selected input vector, wherein the control device is configured to carry out the treatment program assigned to the matrix element determined.

For example the program parameters comprise a cleaning intensity, a drying intensity and/or a program duration.

In accordance with a further form of embodiment the household appliance comprises a selection unit, which is configured to interpret the user feedback detected by the input means for changing at least one program parameter and to select one of the specific N-dimensional input vectors depending on the interpreted feedback, and a determination unit for determining a matrix element from the matrix by means of the selected input vector, wherein the control device is configured to carry out the treatment program assigned to the matrix element determined.

Via the interpreted feedback the user can adjust the cleaning intensity, the drying intensity and the program duration. Depending on this adjustment a specific input vector of the N input vectors is selected, a corresponding matrix element determined and the treatment program assigned to the matrix element carried out.

By means of the interpreted feedback and especially by means of a stored series of interpreted feedbacks the adjustment unit is also able to deduce to what extent the respective user is interested in the processes of the household appliance or rejects this and could possibly be feeling stressed by too frequent feedback surveys. Consequently the adjustment unit can use the series of interpreted feedbacks to tailor the operation of the household appliance to the respective user and thereby to personalize it. Through this the program parameters are approximated over time to the optimal conditions for the user by utilizing the technical possibilities of the household appliance. The results are assessed for the specific customer and not just on standard criteria.

In the present invention the process technology available in the household appliance is used in the optimal way, taking into account the individual preferences of the user, communicated in particular by means of their feedback. In this case the user, through their user input or their feedback, can change at least one of the program parameters that determine the treatment program to be selected.

The program parameters comprise a cleaning intensity, a drying intensity and a program duration for example. Depending on the user input or the feedback detected for changing the program parameter, a specific input vector of the possible input vectors is selected. By means of the selected input vector that matrix element from the matrix for storage of the treatment programs is determined that is then assigned in its turn to the selected input vector. Through the matrix element determined a specific program of the possible treatment programs is identified and thus determined. This treatment program determined can then be carried out by the control device. The assignment of the treatment programs to the matrix elements of the matrix takes place depending on the program parameters used for mapping the user's wishes in accordance with user input and is thus selected especially sensibly. If the user wants the cleaning intensity to be increased for example, then the matrix element arranged after the current matrix element in the matrix has an increased cleaning intensity. If one of the program parameters, for example the cleaning intensity, is considered, then the matrix elements in this dimension of the matrix are arranged in ascending order in accordance with their intensity. The same preferably applies to the further program parameters.

In accordance with a further form of embodiment the number of the program parameters that can be set is N, wherein the N-dimensional input vector has N vector components. In this case the respective vector component of the input vector is related to one of the N dimensions of the matrix. If in the above example three program parameters, the cleaning intensity, the drying intensity and the program duration exist, then the respective input vector also has three vector components.

In accordance with a further form of embodiment the matrix is a three-dimensional ($x^x y^x z$) matrix, with N=3. In this case x, y and z are discrete values and the number M of the treatment programs corresponds to a product of x, y and z. When for example there are four adjustment options for each of the program parameters, then the result produced is M=4*4*4=64 different treatment programs and this 64 different input vectors that can be selected.

In accordance with a further form of embodiment x determines a range of values of a first vector component of the input vector, y determines a range of values of a second vector component of the input vector and z determines a range of values of a third vector component of the input vector.

In accordance with a further form of embodiment the adjustment unit is configured to adjust the feedback cycle depending on an emotional state of the user detected by the emotion recognition unit.

In this form of embodiment the detected emotional state forms the detected feedback and the emotion recognition unit forms the input means or at least a part of the input means. The emotional state can also be referred to as the mood or emotion.

In accordance with a further form of embodiment the adjustment unit is further configured to adapt the content of the feedback survey depending on the detected emotional state of the user.

Advantageously, by means of the emotional state detected, the feedback cycle and/or the content of the feedback survey can be adapted. Furthermore direct system adaptations of the household appliance can be derived from the emotional state detected. In this case the emotion recognition unit is configured to determine the emotional state by detection and analysis of audiovisual signals, for example. The emotion recognition unit can be integrated into the household appliance or arranged externally to said appliance. An external arrangement of the emotion recognition unit is produced for example as a separate dedicated facility or is integrated into a mobile terminal, into a smartphone for example.

The emotion recognition unit comprises a microphone for example for detecting the noises from the surroundings of the household appliance. The emotion recognition unit can further be configured, with the aid of frequency analyses, for example focusing on the tone of voice of the user, to reach conclusions as to their mood. Furthermore the emotion recognition unit, as an alternative or in addition, can be configured to detect an intensity of key presses, for example on a haptic input means.

The emotion recognition unit can also be coupled to a number of cameras or have such a camera to detect the emotional state of the user, by means of an analysis of movement profiles of the user for example, their current facial expression and/or gesticulation.

Furthermore the adjustment unit is especially configured to adjust the feedback cycle and/or the content of the feedback survey not only depending on a current emotional state of the user detected, but also depending on its frequency.

In accordance with a further form of embodiment the household appliance integrates the input means.

For example the input means has a speech dialog system, which is configured to detect the user's feedback in the form of speech inputs as responses of the user to the feedback survey generated by the speech dialog system.

As an alternative or in addition the input means has a touch-sensitive display, which is configured to detect the user's feedback in the form of display entries as responses of the user to the feedback questions output by the display.

In accordance with a further form of embodiment the input means comprises a speech dialog system, a touch-sensitive display and/or an emotion recognition unit. In this case the respective part of the input means can be arranged internally in or externally to the household appliance.

In particular the household appliance comprises a communication unit, which for example is able to be coupled by means of a network to the external facility and thus to the App installed on the external facility. The network in this case in particular comprises a mobile radio network, a WLAN and/or a further wireless or wired data network.

In accordance with a second aspect a system with a household appliance in accordance with the first aspect or one of the forms of embodiment of the first aspect and with a facility external to the household appliance is proposed, wherein the input means is embodied as an App able to be installed on the external facility.

In accordance with a third aspect a method is proposed for operating a household appliance, in particular a water-conducting appliance, with a control device for carrying out a treatment program from a plurality M of treatment programs, wherein each of the treatment programs is determined by a number of program parameters. The method comprises the following steps:

a) Outputting a feedback survey in accordance with a feedback cycle to a user of the household appliance, and
b) Adjusting the feedback cycle depending on the user's feedback detected by an input means.

The forms of embodiment and features described for the proposed household appliance apply correspondingly to the proposed method.

In accordance with a fourth aspect a computer program product is proposed, which causes the method as described above to be carried out on a program-controlled facility.

A computer program product, such as e.g. a computer program means, can for example be provided or delivered as a storage medium, such as e.g. a memory card, USB stick, CD-ROM, DVD or also in the form of a downloadable file from a server in the network. This can for example be done in a wireless communication network by the transmission of a corresponding file with the computer program or the computer program means.

Further possible implementations of the invention also comprise combinations not explicitly mentioned of features or forms of embodiment described above or below in relation to the exemplary embodiments. In such cases the person skilled in the art will also add individual aspects to the respective basic form of the invention as improvements or enhancements.

BRIEF DESCRIPTION OF THE DRAWINGS

Further advantageous embodiments and aspects of the invention are the subject matter of the dependent claims as well as the exemplary embodiments of the invention described below. Furthermore the invention will be explained in more detail with the aid of preferred forms of embodiment that refer to the enclosed figures.

DETAILED DESCRIPTION OF EXEMPLARY EMBODIMENTS OF THE PRESENT INVENTION

Figure 1:
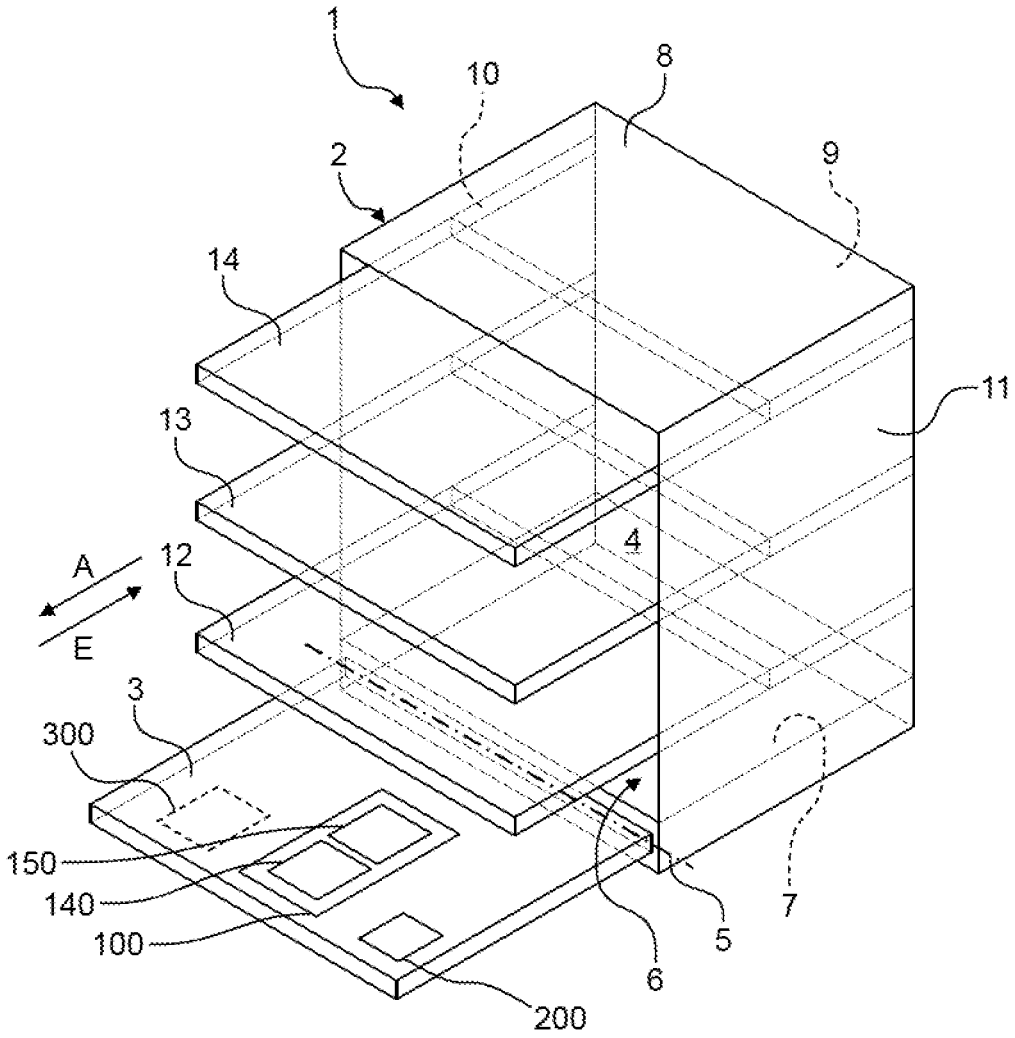
FIG. 1 shows a schematic perspective view of an exemplary embodiment of a household dishwasher.

Elements that are the same or have the same functions have been provided with the same reference characters in the figures, unless stated otherwise.

Figure 2:
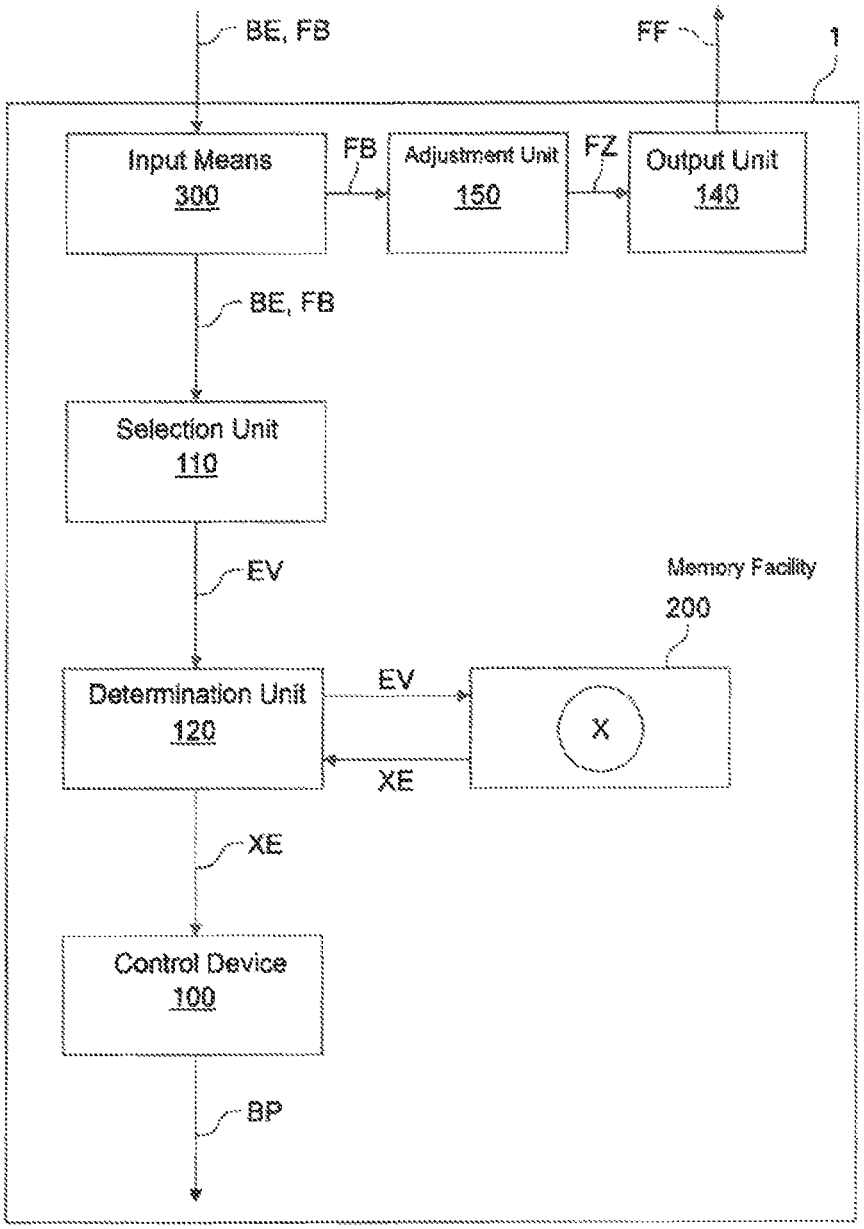
FIG. 2 shows a schematic view of details of the exemplary embodiment of the household dishwasher as depicted in FIG. 1.
Figure 3:
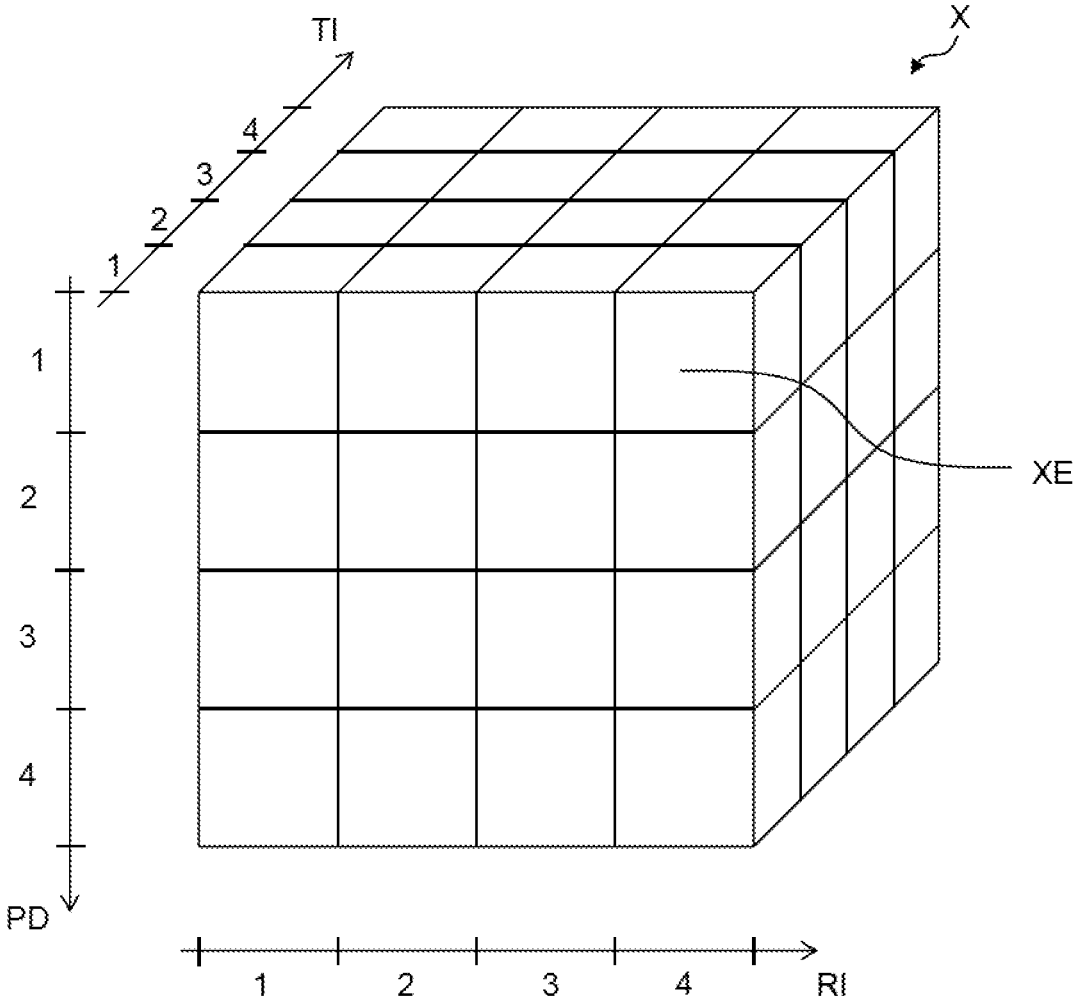
FIG. 3 shows a schematic view of a matrix for storing treatment programs for the household dishwasher as depicted in FIG. 1.

A first exemplary embodiment of a household dishwasher as an example of a household appliance 1 is explained with reference to FIGS. 1 to 3. In this regard FIG. 1 shows a schematic perspective view of an exemplary embodiment of the household dishwasher 1. FIG. 2 shows a schematic view of details of the exemplary embodiment of the household dishwasher as depicted in FIG. 1 and FIG. 3 shows a schematic view of a matrix X for storage of treatment programs BP for the household dishwasher 1 as depicted in FIG. 1.

The household dishwasher 1 comprises a washing container 2, which is able to be closed off, in particular in a watertight manner, by a door 3. To this end a sealing facility (not shown) can be provided between the door 3 and the washing container 2. The washing container 2 is preferably cuboid in shape. The washing container 2 can be arranged in a housing of the household dishwasher 1. The washing container 2 and the door 3 can form a dishwashing compartment 4 for washing dishes 15.

The door is shown in FIG. 1 in its opened position. The door 3 can be closed or opened by pivoting it around a pivot axis 5 provided at a bottom end of the door 3. With the aid of the door 3 a loading opening 6 of the washing container can be opened or closed. The washing container 2 has a floor 7 and a roof 8 arranged opposite the floor 7, a rear wall 9 arranged opposite the closed door 3 and two sides walls 10, 11 arranged opposite one another. The floor 7, the roof 8, the rear wall 9 and the side walls 10, 11 can be manufactured from a sheet of stainless steel, for example. As an alternative the floor 7 can be made of a plastic material, for example.

The household dishwasher 1 further has at least one dish receptacle 12, 13, 14. Preferably a number of, at least three, dish receptacles 12, 13, 14 can be provided, wherein the dish receptacle 12 is a lower dish receptacle or a lower basket, the dish receptacle 13 is an upper dish receptacle or an upper basket and the dish receptacle 14 can be a cutlery tray. As FIG. 1 also shows, the dish receptacles 12, 13, 14 are arranged one above the other in the washing container 2. Each dish receptacle 12, 13, 14 is optionally able to be moved into the washing container 2 or moved out of it. In particular each dish receptacle 12, 13, 14 is able to be pushed into the washing container 2 in a push-in direction E and pulled out of the washing container 2 in a pull-out direction A opposite to the push-in direction E.

The household dishwasher 1 moreover has a control device 100, which is arranged on the door 3.

The control device 100 of FIG. 1 is configured to carry out a treatment program BP from a plurality M of treatment programs BP (see FIG. 3). Each of the treatment programs BP is determined by a number of program parameters RI, TI, PD. Examples of program parameters are a cleaning intensity RI, a drying intensity TI and a program duration PD, which the user can adjust.

The control device 100 of the household dishwasher 1 depicted in FIG. 1 comprises an output unit 140 and an adjustment unit 150. The household dishwasher 1 depicted in FIG. 1 further has a memory facility 200 and also an input means 300 for detecting user inputs BE of the user of the household dishwasher 1. User feedback FB in this case represents a specific user input BE.

Further examples of user inputs BE comprise those user inputs or user commands for directly changing program parameters RI, TI, PD (see FIG. 3) or for directly selecting a treatment program BP.

The memory facility 200 is embodied for example as a RAM, as an EPROM or as an EEPROM. The memory facility 200 is embodied to store the M treatment programs BP in the form of an N-dimensional matrix. For the example N=3, FIG. 3 shows an example of a matrix X for storage of 64 treatment programs for the household dishwasher 1 as depicted in FIG. 1. The x axis of FIG. 3 shows the cleaning intensity RI, the y axis shows the drying intensity TI and the z axis shows the program duration PD. Thus, in the example depicted in FIG. 3, for each of the program parameters, RI, TI and PD, there are four adjustment options and thus M=4*4*4=64 different treatment programs BP.

The matrix X of FIG. 3 has 64 matrix elements XE and each of the matrix elements XE is assigned to one of the 64 treatment programs BP, in particular uniquely assigned to it. The respective matrix element XE is able to be determined by one of a plurality of specific N-dimensional input vectors EV. As explained above, N equates to 3 for the examples depicted in FIGS. 1 to 4 (N=3).

Figure 4:
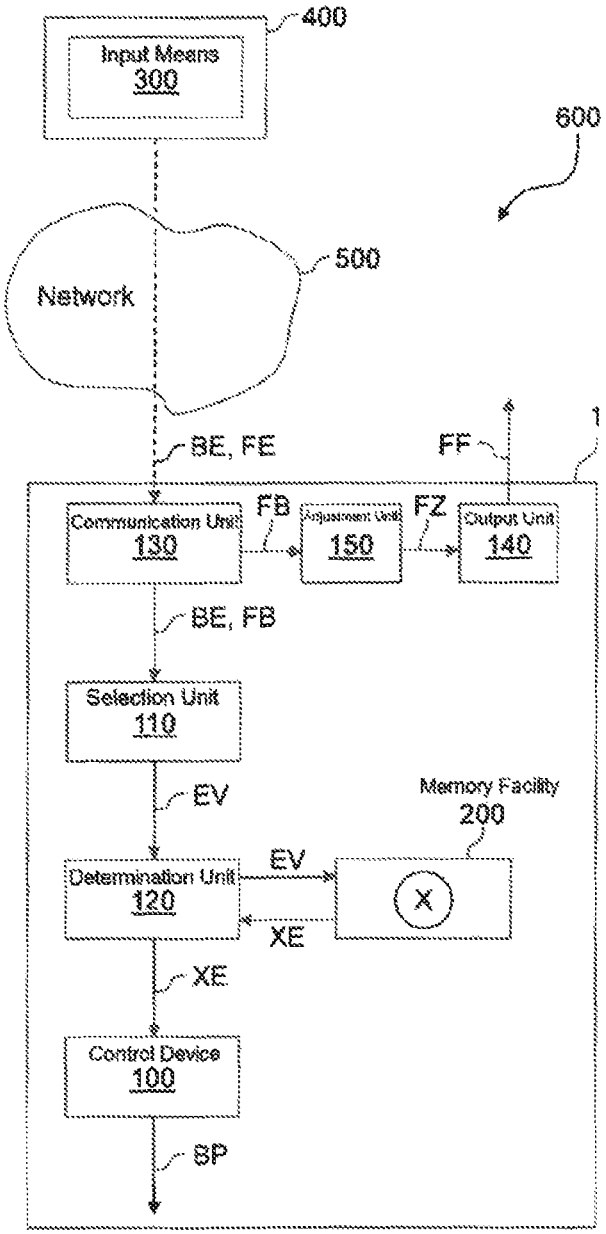
FIG. 4 shows a schematic perspective view of an exemplary embodiment of a system with a household dishwasher.

To this end FIG. 2 shows a schematic view of details of the exemplary embodiment of the household dishwasher 1 as depicted in FIG. 1. In the example of FIGS. 1 to 3 the input means 300 is part of the household dishwasher 1. With reference to FIG. 4 a further exemplary embodiment will be explained, in which the input means 300 is external to the household dishwasher 1.

The input means 300 is configured to detect user inputs BE, such as e.g. user feedbacks FB in response to a feedback survey with one or more feedback questions FF. As stated above a feedback is a specific user input BE.

In this case the output unit 140 is configured to output to the user of household dishwasher 1 a feedback survey FF in accordance with a feedback cycle FZ.

Example of such feedback questions FF comprise "Were you satisfied with the cleaning performance?", "Were you satisfied with the drying performance?", Were you satisfied with the program duration?".

If the input means 300 detects a user feedback FB in response to such a feedback survey FF, then the input means 300 forwards the feedback FB detected to the adjustment device 150. The adjustment unit 150 is configured in this case to adjust the feedback cycle FZ depending on the feedback FB detected. The adjusted, where necessary extended or reduced, feedback cycle FZ is output by the adjustment unit 150 to the output unit 140 so that the output unit 140 has the opportunity of outputting the next feedback survey FF to the user of the household appliance 1 in accordance with the updated feedback cycle FZ.

If for example the input means 300 detects a feedback FB with positive content then the adjustment unit 150 will preferably automatically extend the feedback cycle FZ or offer the user an extension of the feedback cycle by means of an output by the output unit 140. If the input means 300 detects a feedback FB with negative content then the adjustment unit 150 is preferably configured to automatically reduce the feedback cycle FZ or to offer the user a reduction of the feedback cycle FZ by means of an output by the output unit 140.

To adjust the feedback cycle FZ the adjustment unit 150 preferably, as well as the detected feedback FB, also uses series of detected feedbacks FB and/or data detected during the use of the household appliance 1. Such data detected during the use of the household appliance 1 comprises for example data for device setting of the household appliance 1, data about treatment programs BP carried out, data about inputs BE of the user made before or during the treatment programs BP carried out and detected by the input means 300, an assessment history comprising a plurality of user feedbacks FB detected by the input means 300 during the treatment programs BP carried out and/or at least one sensor signal or a series of sensor signals of a number of sensors built into the household appliance 1. Examples of such sensors built into the household appliance 1 include turbidity sensors, soiling level sensors, drying sensors and cameras arranged in the dishwashing compartment 4 of the household appliance 1.

The adjustment unit 150 is further configured to adapt a content of the feedback survey FF depending on the detected feedback FB of the user. In this adaptation the adjustment unit 150 can preferably also use data mentioned above, which was detected during use of the household appliance 1.

The memory facility 200 can preferably also be configured to store a series of a plurality of detected feedbacks FB of the user for a series of treatment programs BP carried out. In this case the respective detected feedback FB is preferably assigned to the respective treatment program BP carried out.

In this case the control device 100 is especially configured, for a specific feedback FB detected by the input means 300, to select a treatment program BP of the series of treatment programs BP stored by the memory facility 200 and to carry out the selected treatment program BP. This means that the control device 100, depending on the current feedback FB in the series of feedbacks and the assigned treatment programs BP, can select the current optimal treatment program. If for example the user gives a feedback such as "The performance was better last time", then the control device 200 can go back in the series of feedbacks given in order to then select once again the last but one treatment program BP carried out.

In other words the control device 100 can be configured, for a feedback FB detected by the input means 300 with a negative content, to select such a treatment program BP as is stored in the memory facility 200 assigned to a feedback FB with a positive content and subsequently to carry out the selected treatment program BP.

As FIG. 2 shows, the input means 300 can forward user inputs BE, such as feedbacks FB, to a selection unit 110.

Two different cases A and B will be considered differentiated below, which have in common that at least one of the program parameters RI, TI, PD is changed. In case A the input means 300 detects a user input BE for directly changing at least one of the program parameters RI, TI, PD. In case B the input means 300 detects a feedback FB, which is interpreted, wherein the interpreted feedback FB then causes at least one of the program parameters RI, TI, PD to be changed.

Case A:

The input means 300 detects a user input BE for directly changing at least one of the program parameters RI, TI, PD.

The selection unit 110 is configured to select one of the specific N-dimensional input vectors EV depending on the user input BE detected.

With N=3 the input vector EV is a three-dimensional input vector with three vector components. Each one of the vector components of the input vector EV is related to one of the three dimensions of the matrix X of FIG. 3. For example, the first vector component of the input vector EV is related to the x axis of the matrix X, the second vector component of the input vector EV is related to the y axis of the matrix X and the third vector component of the input vector EV is related to the z axis of the matrix X.

In this example there are accordingly also 64 different specific input vectors EV, which can be selected by means of the selection unit 110.

If for example the input vector is EV(RI, PD, TI)=(3, 1, 1) at a specific point in time, then this means that the cleaning intensity is set to 3, the program duration PD is set to 1 and the drying intensity TI is set to 1. If the user then changes the input vector EV(RI, PD, TI) to (4, 1, 1) by means of a user input BE, then they have increased the cleaning intensity RI by 1 by means of their user input BE (from 3 to 4). The detected user input BE is transferred from the input means 300 to the selection unit 110. The selection unit 110 then selects the three-dimensional input vector EV(RI, PD, TI)=(4, 1, 1) and passes this to the determination unit 120.

The determination unit 120 determines a matrix element XE from the matrix X by means of the selected input vector EV(RI, PD, TI)=(4, 1, 1). The matrix element XE determined is labeled with the reference character XE in FIG. 3.

The matrix element XE determined is then passed from the determination unit 120 to the control device 100 in such a way that said device is configured to carry out the treatment program BP assigned to the matrix element XE determined.

For a user input BE detected by the input means 300 for changing one of the program parameters RI, TI, PD outside the specific range of values the control device 100 preferably determines a measure and triggers or brings about the execution of the measure determined. If, for example, the range of values for the cleaning intensity RI as in the example given above is [1, 2, 3, 4] but the user gives the value of 5 for the cleaning intensity RI by means of voice input, then their user input BE for changing the program parameter cleaning intensity RI lies outside the specified range of values of [1, 2, 3, 4]. A suitable measure can then be to adapt specific operating parameters for improving the cleaning intensity, such as for example the washing liquor temperature.

Case B:

In case B the selection unit 150 receives a feedback FB detected by the input means 300 and interprets the detected feedback in order to change at least one of the program parameters RI, TI, PD. If for example the feedback detected is "Dissatisfied with the cleaning intensity" then the selection unit 100 will interpret this detected feedback FB in such a way that the program parameter cleaning intensity RI is incremented at least by 1. Accordingly the selection unit selects the input vector EV depending on the interpreted feedback FB and passes this selected input vector EV to the determination unit 120. The determination unit 120 determines a matrix element XE from the matrix X by means of the selected input vector EV. The control device 100 is then configured to carry out the treatment program BP assigned to the matrix element XE determined.

The input means 300 comprises a touch-sensitive display for example, which, for example—as shown in FIG. 1—is arranged on the outer side of the door 3.

The touch-sensitive display is configured to detect a feedback FB of the user in the form of display inputs as responses of the user to feedback questions FF output by the display. For the example given above of changing the program parameter RI such a question to the user can be "Do you want to increase the cleaning intensity?". The user is then provided with two more input fields via the touch-sensitive display, one being the input field with "Yes" and one being the input field with "No". In the example shown above the user has touched the input field "Yes", so that the input vector EV(RI, PD, TI)=(4, 1, 1) is selected.

FIG. 4 further shows a schematic perspective view of an exemplary embodiment of a system 600 with a household dishwasher 1. The exemplary embodiment of FIG. 4 differs from the exemplary embodiment depicted in FIGS. 1 and 2 in so far as the input means 300 is arranged externally to the household dishwasher 1. In the example of FIG. 4 the input means is embodied as an App, which is installed on an external device 400, for example on a smartphone or on a tablet and is operated on said device.

The user can then input the user input BE (or the feedback FB) by means of the App 300 and by means of the App 300 the detected user input BE (or the feedback FB) is transmitted via a network 500, for example the Internet or an intranet, to the household dishwasher 1. For communication with an external facility 400 the household dishwasher 1 comprises a communication unit 130. In the example of FIG. 4 the communication unit 130 receives the detected user input BE (or the feedback FB) and forwards the received user input BE (or the feedback FB) to the selection unit 110, for example.

The App 300 can for example also form a speech dialog system on the external facility 400. The speech dialog system is configured in particular to detect a feedback FB of the user in the form of speech inputs as responses of the user to speech outputs generated by the speech dialog system as feedback questions FF. For example, the speech dialog system can ask the user whether they want a reduced feedback cycle FZ. By means of a speech input the user can then tell the speech dialog system whether they want a reduced feedback cycle FZ or not.

The other functionalities are in accordance with the example depicted in FIG. 2.

Figure 5:
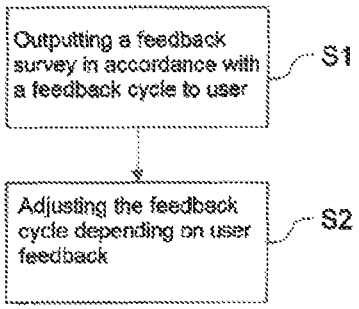
FIG. 5 shows a schematic block diagram of an exemplary embodiment of a method for operating a household dishwasher.

FIG. 5 shows a schematic block diagram of a method for operating a household appliance, such as for example the household dishwasher 1 of FIG. 1 or FIG. 4. The method of FIG. 5 comprises the steps S1 and S2: In step S1 a feedback survey FF in accordance with a feedback cycle FZ is output to a user of the household appliance 1. The feedback cycle FZ is determined by the period of time between two consecutive feedback surveys FF for triggering a respective feedback FB by the user.

In step S2 the feedback cycle FZ is adjusted depending on user feedback FB detected by an input means 300 (see FIG. 1, FIG. 2, FIG. 4).

Although the present invention has been described with the aid of exemplary embodiments, it is able to be modified in a variety of ways.

The invention claimed is:

1. A household appliance, comprising:

a control device configured to carry out a treatment program from a plurality of treatment programs, each of the plurality of treatment programs being determined by a plurality of program parameters;

an output unit configured to output a feedback survey in accordance with a feedback cycle to a user of the household appliance, wherein the feedback cycle is a period of time between consecutive output of the feedback survey by the output unit; and an adjustment unit configured to adjust the feedback cycle depending on a user feedback detected by an input means.

2. The household appliance of claim 1, constructed in the form of a water-conducting household appliance.

3. The household appliance of claim 1, wherein the adjustment unit is configured to automatically extend the feedback cycle for feedback with a positive content detected by the input means or to offer the user an extension of the feedback cycle via an output by the output unit.

4. The household appliance of claim 1, wherein the adjustment unit is configured to automatically reduce the feedback cycle for feedback with a negative content detected by the input means or to offer the user a reduction of the feedback cycle via an output by the output unit.

5. The household appliance of claim 1, wherein the adjustment unit is configured to adjust the feedback cycle depending on the user feedback detected by the input means and depending on data detected during use of the household appliance.

6. The household appliance of claim 4, wherein the data detected during use of the household appliance comprises:

data about device settings of the household appliance, data about treatment programs carried out, data about user inputs made before or during the treatment programs carried out and detected by the input means, an assessment history comprising a plurality of user feedbacks detected by the input means during the treatment programs carried out, and/or at least one sensor signal or a series of sensor signals of a number of sensors built into the household appliance.

7. The household appliance of claim 1, wherein the adjustment unit is configured to adapt a content of the feedback survey depending on the detected user feedback.

8. The household appliance of claim 7, wherein the adjustment unit is configured to adapt a content of the feedback survey depending on the detected user feedback and depending on data detected during use of the household appliance.

9. The household appliance of claim 1, further comprising a memory facility configured to store a series of a plurality of user feedbacks detected by the input means for a series of executed treatment programs, with each of the detected user feedback assigned to a corresponding one of the executed treatment programs being stored.

10. The household appliance of claim 9, wherein the memory facility is configured to store the plurality of treatment programs in the form of an N-dimensional matrix, with matrix elements of the matrix being assigned to the plurality of treatment programs in one-to-one correspondence, wherein the matrix elements are each determinable from a plurality of specified N-dimensional input vectors.

11. The household appliance of claim 10, further comprising:

a selection unit configured to interpret the user feedback detected by the input means for changing at least one of the program parameters and to select one of the specified N-dimensional input vectors depending on the interpreted feedback; and a determination unit configured to determine a respective one of the matrix elements from the matrix using the selected one of the input vectors, wherein the control device is configured to carry out the treatment program assigned to the respective one of the matrix elements.

12. The household appliance of claim 1, wherein the adjustment unit is configured to adjust the feedback cycle depending on an emotional state of the user detected by an emotion detection unit.

13. The household appliance of claim 1, wherein the input means is an integral part of the household appliance, said input means configured in at least one of two ways, a first way in which the input means includes a speech dialog system configured to detect the user feedback in the form of speech inputs as responses of the user to feedback questions of the feedback survey generated by the speech dialog system, a second way in which the input means includes a touch-sensitive display configured to detect the user feedback in the form of display inputs as responses of the user to feedback questions output by the display.

14. A system, comprising:

a household appliance comprising a control device configured to carry out a treatment program from a plurality of treatment programs, each of the plurality of treatment programs being determined by a plurality of program parameters, an output unit configured to output a feedback survey in accordance with a feedback cycle to a user of the household appliance, wherein the feedback cycle is a period of time between consecutive output of the feedback survey by the output unit, and an adjustment unit configured to adjust the feedback cycle depending on a user feedback detected by an input means; and a facility external to the household appliance, wherein the input means is embodied as an App installed on the external facility.

* * * * *